US007098181B2

(12) United States Patent
Inoue et al.

(10) Patent No.: US 7,098,181 B2
(45) Date of Patent: Aug. 29, 2006

(54) LIQUID DETERGENT COMPOSITION

(75) Inventors: Takumi Inoue, Wakayama (JP); Kazunori Tsukuda, Wakayama (JP); Mitsuru Uno, Wakayama (JP)

(73) Assignee: Kao Corporation, Tokyo (JP)

( * ) Notice: Subject to any disclaimer, the term of this patent is extended or adjusted under 35 U.S.C. 154(b) by 431 days.

(21) Appl. No.: 10/436,330

(22) Filed: May 13, 2003

(65) Prior Publication Data

US 2004/0023834 A1 Feb. 5, 2004

(30) Foreign Application Priority Data

May 22, 2002 (JP) ..... 2002-147467

(51) Int. Cl.
*C11D 1/68* (2006.01)
*C11D 3/16* (2006.01)
*C11D 3/43* (2006.01)

(52) U.S. Cl. ..... 510/506; 510/182; 510/191; 510/197; 510/199; 510/238; 510/239; 510/240; 510/417; 510/421; 510/527

(58) Field of Classification Search ..... 510/182, 510/191, 197, 199, 238, 239, 240, 417, 421, 510/506, 527

See application file for complete search history.

(56) References Cited

U.S. PATENT DOCUMENTS

| | | | | |
|---|---|---|---|---|
| 3,427,248 | A | 2/1969 | Lamberti et al. | |
| 4,430,237 | A | 2/1984 | Pierce et al. | |
| 4,576,967 | A | 3/1986 | Urata et al. | |
| 6,232,283 | B1 * | 5/2001 | Inoue et al. | 510/405 |
| 6,387,867 | B1 * | 5/2002 | Ishikawa et al. | 510/421 |

FOREIGN PATENT DOCUMENTS

| | | |
|---|---|---|
| EP | 0 926 231 | 6/1999 |
| GB | 440642 | * 12/1935 |
| JP | 57-133200 | 8/1982 |
| JP | 64-67235 | 3/1989 |
| JP | 2-29498 | 1/1990 |
| JP | 2-32197 | 2/1990 |
| JP | 2-182793 | 7/1990 |
| JP | 3-269097 | 11/1991 |
| JP | 5-502687 | 5/1993 |
| JP | 6-306400 | 11/1994 |
| JP | 7-3289 | 1/1995 |
| JP | 7-500861 | 1/1995 |
| JP | 11-189796 | 7/1999 |
| JP | 11-256200 | 9/1999 |
| JP | 2002-20791 | 1/2002 |
| WO | WO 91/09926 | 7/1991 |
| WO | WO 93/09214 | 5/1993 |

* cited by examiner

*Primary Examiner*—Brian P. Mruk
(74) *Attorney, Agent, or Firm*—Oblon, Spivak, McClelland, Maier & Neustadt, P.C.

(57) ABSTRACT

The invention provides a liquid detergent composition which is safe, has an excellent detergency and contains a hydrophobic organic solvent stable despite of a large water content. The present invention relates to a liquid detergent composition comprising (a) a specific compound having an alkyl or alkenyl group having 3 to 11 carbon atoms and a group having 4 to 30 carbon atoms in total and 2 to 10 hydroxy groups, (b) a hydrophobic organic solvent which is liquid at 20° C. and (c) water, wherein (b)/(c)=0.05/9.95 to 4/6 (mass ratio) and (b)+(c)=50 to 99 mass %.

19 Claims, 1 Drawing Sheet

0.5 μm

LIQUID DETERGENT COMPOSITION

FIELD OF THE INVENTION

The present invention relates to a detergent for hard surfaces such as bathrooms, kitchen facilities, floors and lavatories, and particularly to a liquid detergent composition having excellent detergency effected on oily stains denatured by heat, light or oxidation, scam soils in bathrooms or complex dirt produced on other hard surfaces and the like.

BACKGROUND ART

Generally, detergents are used to remove different soils corresponding to hard surfaces such as bathrooms, kitchens and floors and therefore those having compositions suitable to each of these hard surfaces are used. For instance, as detergents for kitchen facilities, those containing surfactants, solvents, alkali agents and the like are used in order to remove oily soils denatured by the actions of heat, sunlight, oxygen in the atmosphere and the like. Also, as detergents for bathrooms, detergents containing surfactants, solvents, metal ion sequestering agents and the like are used to remove soils such as sebum, metal soaps, particularly, calcium salts of fatty acids. Many technologies have been developed so far.

It has been also known that excellent detergency is obtained by compounding a polyol type compound having an alkyl or alkylene chain in these detergents. As the polyol compound, alkyl glyceryl ether type compounds, saccharide type compounds such as alkyl glycosides and fatty acid ester type compounds of (poly) glycerol are known. For example, with regard to alkyl glyceryl ether type compound, a liquid detergent using a monoalkyl monoglyceryl ether having 5 or less carbon atoms in the alkyl group is described in the publication of JP-A No. 7-3289. It is described in Japanese Patent Application National Publication (Laid-Open) No. 7-500861 that a glyceryl ether of an alkyl group having 12 to 18 carbon atoms wherein 50 mol % or more of the glycerol ether is di-isomers is contained and compounds such as high-molecular hydrocarbons such as a paraffin, fatty acid esters, fatty acid esters of monohydric alcohols and aliphatic $C_{18}$ to $C_{40}$ ketones may be contained as a non-surfactant foaming resistant agents though these compounds are optional components. Liquid detergents exhibiting more excellent detergency by using a mixture consisting of a combination of monoalkyl monoglyceryl ethers having 1 to 11 carbon atoms in the alkyl group and differing in the number of carbon atoms or a combination of isomer alkyls among these ethers are described in the publication of JP-A No. 11-189796. In the publication of JP-A No. 11-256200, there are descriptions concerning a liquid detergent composition containing a monoglycerol ether derivative having any one of an alkyl group having 1 to 12 carbon atoms, an alkenyl group, a benzyl group or a phenyl group, a terpene type hydrocarbon, a surfactant and a builder. As to other liquid detergent compositions containing a glyceryl ether derivative, there are descriptions concerning a liquid detergent composition which is formulated with a monoalkyl monoglyceryl ether having a methyl-branched alkyl group and exhibits excellent detergency effected on oily stains and sebum soils in JP-A No. 57-133200, and concerning a detergent containing a monoalkyl (mono, di or tri)glyceryl ether having 8 to 16 carbon atoms in the publication of U.S. Pat. No. 4,430,237. Also, examples of detergents containing a polyol compound represented by the formula containing a glycerol ether derivative may include detergents disclosed in each publication of U.S. Pat. No. 3,427,248, JP-A No. 64-67235 and JP-W No. 5-502687.

As detergents containing an alkyl glycoside type compound, liquid detergents containing an alkyl glycoside type surfactant, a monoterpene or sesquiterpene type hydrocarbon and other components are described in each publication of JP-A Nos. 2-182793, 2-32197 and 3-269097.

In the meantime, as technologies concerning a liquid detergent using a hydrophobic organic solvent, those described in the publication of JP-A No. 2-29498 besides the aforementioned liquid detergents compounded with a terpene type hydrocarbon may be exemplified. A liquid detergent composition containing 0.01 to 1.0% by weight of an anionic surfactant, 0.01 to 1.0% by weight of terpene or sesquiterpene type hydrocarbon solvent and 0.001 to 0.1% by weight of water-soluble divalent metal is described in this publication. It is to be noted that hydrocarbons such as paraffin is compounded as a foam resistant agent and it is described in the publication of the aforementioned JP-W No. 7-500861 that these hydrocarbons may be compounded as optional components.

However, a part of current polyol type compounds is one exhibiting excellent detergency effected on denatured oily stains and the like, but are highly soluble in water and therefore, only insufficient effect is obtained in the case of detergents having a large water content. Although there is also an idea that the concentration of a solvent is increased, not only an economical problem arise but also sticky feeling remains, requiring wiping with water for finishing.

On the other hand, current liquid detergents using a hydrophobic organic solvent are stabilized by incorporating the hydrophobic organic solvent into the micelle of a surfactant, namely, by forming an o/w emulsion to obtain a uniform and stable liquid and therefore satisfactory detergency cannot be obtained. This is considered to be because the surfactant surrounds the hydrophobic organic solvent with the lipophilic group being positioned inside and the hydrophilic group being positioned outside, thereby confining the hydrophobic organic solvent. Therefore, one which is brought into contact with soils when cleaning is the solvent confined in the micelle of the surfactant. For this, the effect that the solvent originally has can be exhibited insufficiently.

In view of this, there is an idea that the amount of a water-insoluble solvent to be compounded is increased to make a w/o emulsion. For example, a liquid detergent containing orange oil as its major component has been already known. However, when the amount of the hydrophobic organic solvent is increased, this is undesirable not only from an economical problem but also from the viewpoint of safety in generally domestic uses in the case of using a flammable hydrophobic organic solvent such as hydrocarbon solvents. If a hydrophobic organic solvent having low volatility is used, however, not only the solvent is a cause of sticky feeling after used but also it is difficult to wipe the solvent because it cannot be wiped with water.

It is disclosed in the publication of JP-A No. 6-306400 that a near three-critical point composition constituted of (1) an amphipathic solvent such as triethylene glycol monohexyl ether, (2) a non-polar solvent or less-polar solvent such as a hydrocarbon and (3) a polar solvent such as water is used as a detergent. However, a system containing a large amount of a compound such as triethylene glycol monohexyl ether and diethylene glycol butyl ether used for the example of the technique in the publication in which the number of hydroxyl groups is only one cannot exhibit sufficient detergency.

Also, in the publication of JP-A No. 2002-20791, a liquid detergent forming a bicontinuous phase is disclosed. However, the polarity of a hydrophobic component to be used is high and therefore only insufficient detergency can be obtained.

DISCLOSURE OF THE INVENTION

It is an object of the present invention to achieve a liquid detergent composition containing a hydrophobic organic solvent, the composition being stable despite of a large water content without impairing safety and having excellent detergency.

The present invention relates to a liquid detergent composition comprising (a) a compound represented by the following formula (1) (hereinafter, referred to as a component (a)), (b) a hydrophobic organic solvent which is liquid at 20° C. (hereinafter, referred to as a component (b)) and (c) water (hereinafter, referred to as a component (c)), wherein (b)/(c)=0.05/9.95 to 4/6 (mass ratio) and (b)+(c)=50 to 99 mass %.

$$R—T—[S]_m \quad (1)$$

wherein R represents an alkyl or alkenyl group having 3 to 11 carbon atoms, T represents a group selected from —O—, —COO—, —OCO—,

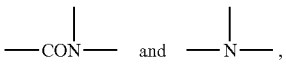

where m is 1 when T is —O—, —COO— or —OCO— and m is 2 when T is

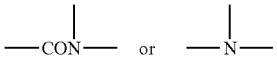

and S represents a group having 4 to 30 carbon atoms in total and 1 to 10 hydroxy groups, provided that m is 2 when S has one hydroxy group and when S has two hydroxy groups, at least one of the groups is a hydroxy group connected to an oxyethylene group or a polyoxyethylene group (average addition mol number: 5 or less and above 1).

EMBODIMENTS OF THE INVENTION

<Component (a)>

The liquid detergent composition of the present invention contains a compound represented by the following formula (1) as the component (a).

$$R—T—[S]_m \quad (1)$$

wherein R represents an alkyl or alkenyl group having 3 to 11, preferably 3 to 8 and more preferably 4 to 8 carbon atoms, T represents a group selected from —O—, —COO—, —OCO—,

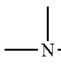

and

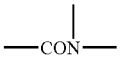

where m is 1 when T is —O—, —COO—, or —OCO— and m is 2 when T is

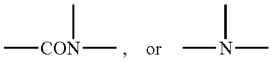

and S represents a group having 4 to 30 carbon atoms in total and 1 to 10 hydroxy groups, provided that m is 2 when S has one hydroxy group and when S has two hydroxy groups, at least one of the groups is a hydroxy group connected to an oxyethylene group or a polyoxyethylene group (average addition mol number: 5 or less and above 1).

The component (a) is preferably a compound having at least one of (i) a secondary carbon atom connected to an oxygen atom in T, (ii) a tertiary carbon atom and (iii) a quaternary carbon atom.

The compound represented by the formula (1) has such a nature that it tends to be oriented to the interface between the hydrophobic organic solvent as the component (b) and water as the component (c) in the present invention. It is considered that the component (a) differs from general surfactants in the point that since the component (a) has plural hydroxyl groups and also an alkyl or alkenyl group having a specified number of carbon atoms, the component (a) is less hydrophilic to the component (b) and is also properly hydrophilic on the other hand. Particularly, this nature becomes stronger in the compound in which at least one of the carbon atoms constituting the alkyl or alkenyl group of R which is defined as a preferable structure is at least one of (i) a secondary carbon atom connected to an oxygen atom in T, (ii) a tertiary carbon atom and (iii) a quaternary carbon atom. In the case where S in the formula (1) is a group derived from sugar, the hydrophobic organic solvent which is the component (b) is incorporated and a firm o/w emulsion is easily formed. Therefore, the component (b) is confined, with the result that there is a tendency that sufficient detergency cannot be obtained. Therefore, the compound of the formula (1) is more preferably one in which S is a group other than those derived from sugar. Examples of the sugar in the present invention include monosaccharides such as galactose and fructose, disaccharides such as maltose and xylobiose, and mixtures of these sugars.

Specific examples of the compound represented by the formula (1) may include compounds represented by the following formulae from (2) to (5).

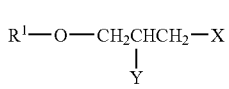

(2)

wherein $R^1$ represents an alkyl or alkenyl group having 3 to 11, preferably 3 to 8, more preferably 4 to 8 carbon atoms, X and Y independently represent a hydroxy group or —O—$CH_2CH(V)CH_2$—W, excluding the case where X and Y are both hydroxy groups, where V and W independently represent a hydroxy group or —O— $CH_2CH(V)CH_2$—W.

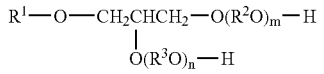

(3)

wherein $R^1$ is the same as above, $R^2$ and $R^3$ represents an ethylene group and/or a propylene group, m and n independently denote a number of 0 to 10 and preferably 0 to 7, excluding the case where the both are 0 and it is more preferable that the sum of m and n is 1 to 3.

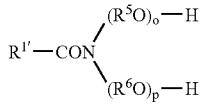

(4)

wherein $R^{1'}$ represents an alkyl or alkenyl group having 3 to 10 carbon atoms, preferably 3 to 7 carbon atoms, $R^5$ and $R^6$ independently represent an alkyl or hydroxyalkyl group having 1 to 3 carbon atoms and o and p independently denote a number of 1 to 10.

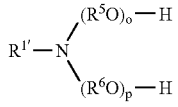

(5)

wherein $R^{1'}$, $R^5$, $R^6$, o and p have the same meanings as above.

The compound represented by the formula (2) may be produced by reacting an alcohol compound represented by $R^1OH$ with an epoxy compound such as epihalohydrin or glycidol by using a Lewis acid catalyst such as $BF_3$. In this reaction, an aluminum catalyst represented by the formula (6) described in the publication of International Patent Application No. 98/50389 is preferably used from the economical point of view and for the purpose of obtaining a desirable detergent effect.

$$Al(OSO_2—R^7)_q(OR^8)_r(OR^9)_s \quad (6)$$

wherein $R^7$ represents a hydrocarbon group which may have a substituent, $R^8$ and $R^9$, which may be the same or different, independently represent a hydrocarbon group which may have a substituent, q denotes a number of 1 to 3 and r and s independently denote a number of 0 to 2 where q+r+s=3.

Here, $R^7$ is preferably an alkyl group having 1 to 5 carbon atoms (preferably a methyl group) or an aryl group which may have a hydroxy group or an alkyl group having 1 to 5 carbon atoms (preferably a 4-tolyl group or a 4-hydroxyphenyl group). Also, $R^8$ and $R^9$ are independently preferably an alkyl group having 1 to 10 carbon atoms (e.g., an isopropyl group or an octyl group) or a phenyl group.

In the case of producing using the above catalyst, the epoxy compound is preferably used in an amount 1.5 to 5 mol equivalents excessive to $R^1OH$ in order to obtain the compound represented by the formula (2) in a high yield. A compound represented by the formula (2) in which both X and Y are hydroxy groups (hereinafter, referred to as a component (a')) is also included. In the present invention, it is preferable that the ratio of the component (a') to the component (a) be 0.1 to 30 mass %, preferably 0.1 to 20 mass %, more preferably 0.1 to 10 mass % and particularly preferably 0.1 to 5 mass % to obtain the effect of the present invention. An operation such as distillation is carried out to accomplish the content of the component (a') like this.

The compound represented by the formula (3) may be produced by adding ethylene oxide and/or propylene oxide to a compound $R^1—O—CH_2CH(OH)CH_2—OH$ which may be produced in the same manner as in the case of the compound represented by the formula (2) (provided that the mol ratio of $R^1OH$ to the epoxy compound is 0.8 to 1.5 and preferably 0.9 to 1.2) in a usual method.

In the compound represented by the formula (4), $—(R^5O)_o—H$ and $—(R^6O)_p—H$ may be different from each other and particularly $R^5$ and $R^6$ are independently an alkylene group having 2 or 3 carbon atoms and preferably an ethylene group and o and p are independently 1 to 10 and preferably 1 to 3.

The compound represented by the formula (4) can be easily synthesized, for example, by running a dehydration reaction between a fatty acid and ethanolamine and by adding an alkylene oxide to the resulting compound.

In the compound represented by the formula (5), $—(R^5O)_o—H$ and $—(R^6O)_p—H$ may be different from each other and particularly $R^5$ and $R^6$ are independently an ethyl group and o and p are independently preferably 1 to 3.

The compound represented by the formula (5) may be obtained, for example, by adding an alkylene oxide to a primary amine having a long-chain alkyl group.

In the present invention, $R^1$ or $R^{1'}$ in the formulae (2) to (5) preferably has at least one of (i) a secondary carbon atom connected to an oxygen atom contained in T, (ii) a tertiary carbon atom and (iii) a quaternary carbon atom from the viewpoint of a detergent effect and the stability of the composition. Also, among the compounds represented by the formulae (2) to (5), one or more types selected from the compounds represented by the formula (2) and the compounds represented by the formula (3) are preferable and the compounds represented by the formula (2) are most preferable.

<Component (b)>

The hydrophobic organic solvent which is liquid at 20° C. and is used in the present invention is an organic solvent of which the solubility parameter (hereinafter, called "sp value") found by the following formula which is well-known is 10.0 to 21.0, preferably 14.0 to 21.0 and more preferably 14.0 to 19.0 and the solubility in water at 20° C. is 0.5 mass % or less. In the above ranges, excellent detergency can be obtained.

The solbility parameter may be for example referred to in Hoy, K. L., The Hoy Tables of Solubility Parameters, Union Carbide Corporation, Solvents and Coatings Materials Division, South Charlston, W. Va.(1985).

$$\delta=(\Delta H/V)^{1/2}$$

δ: solubility parameter (sp value) $[(J/cm^3)^{1/2}]$

ΔH: molar heat of vaporization

V: molar volume

The hydrophobic organic solvent may have an ether group, amide group, ester group and the like as far as the sp value is in the above range. Examples of the component (b) may include a hydrocarbon, a monohydric aliphatic alcohol or an ester thereof, having 6 to 30 carbon atoms in total, another fatty acid ester or an aliphatic ketone or the like. In the present invention, hydrocarbons having 8 to 20 carbon atoms and preferably 8 to 15 carbon atoms are preferable.

Specific examples of the hydrocarbon may include olefin hydrocarbons, paraffin hydrocarbons, aromatic hydrocarbons and terpene type hydrocarbons.

As the olefin hydrocarbons, straight-chain olefin compounds such as hexene, octene, decene, dodecene and tetradecene, branched olefin compounds such as diisobutylene and triisobutylene and cyclic olefin compounds such as cyclohexene and dicyclopentene may be used.

As the paraffin hydrocarbon, straight-chain paraffin compounds such as hexane, heptane, octane, nonane, decane, undecane, dodecane, tridecane, tetradecane and pentadecane, branched paraffin compounds such as isooctane, isohexane and isododecane and cyclic paraffin compounds such as cyclohexane may be used.

Examples of the aromatic hydrocarbon may include toluene, xylene and cumene.

As the terpene type compound, monoterpene compounds which are dimers of isoprene, sesquiterpene compounds which are trimers of isoprene and diterpenes which are tetramers of isoprene may be used. As specific terpene compound, α-pinene, β-pinene, camphene, limonene, dipenetene, terpinolene, myrcene, β-caryophyllene and cedrene are preferable. Particularly, limonene, dipenetene and terpinolene are preferable.

In the present invention, particularly, one or more types selected from straight-chain paraffin compounds, branched paraffin compounds, monoterpene compounds and sesquiterpene compounds are preferable. Particularly, one or more types selected from undecane, dodecane, tridecane, tetradecane, isododecane, limonene, dipenetene and terpinolene are preferable in view of detergent effect.

<Component (c)>

As the water to be used in the present invention, the water which is usually used for a liquid detergent may be used. It is to be noted that highly hard water affects stability. In the present invention, ion exchange water is preferable.

<Liquid Detergent Composition>

The present invention is a liquid detergent composition comprising the components (a), (b) and (c). In order to obtain sufficient detergency and to suppress residues left on the surface after treatment in the liquid detergent of the present invention, (b)/(c) is 0.5/99.5 to 40/60, preferably 1/99 to 30/70 and more preferably 2/98 to 10/90 (mass ratio) and (b)+(c) is 50 to 99 mass %, preferably 55 to 98 mass % and more preferably 70 to 98 mass %.

The concentration of each component is specifically as follows: the component (a) is 0.1 to 30 mass % and particularly 0.5 to 20 mass %, the component (b) is 0.05 to 20 mass % and particularly 0.5 to 15 mass % and the component (c) is 50 to 98.5 mass % and particularly 65 to 97 mass %.

The components (a) and (c) are compounded such that the ratio (a)/(c) of the component (a) to the component (c) is preferably 0.1/9.9 to 5/5, more preferably 0.3/9.7 to 5/5 and most preferably 0.5/9.5 to 3/7 (mass ratio), particularly for stability.

The liquid detergent composition of the present invention preferably contains a surfactant (hereinafter referred to as a component (d)) to the extent that the effect of the present invention is not disturbed, for the purpose of improving detergency. Examples of the component (d) may include an anionic surfactant, a nonionic surfactant, a cationic surfactant or an amphoteric surfactant, being other than the component (a).

Examples of the anionic surfactant include an alkylbenzene sulfonate, a polyoxyalkylene alkyl ether sulfate, an alkyl sulfate, an α-olefin sulfonate, an α-sulfofatty acid salt or an α-sulfofatty acid lower alkyl ester salt, having an alkyl or alkenyl group having 10 to 18 carbon atoms.

Any one among alkylbenzene sulfonates which are being distributed in the market of detergent surfactants may be used as the alkylbenzene sulfonate as far as the average carbon number of the alkyl chain is 8 to 16. For example, Neopelex F25 manufactured by Kao and Dobs102 manufactured by Shell Company and the like may be used. Also, the alkylbenzene sulfonate may be industrially obtained by sulfonating an alkylbenzene which is being widely distributed as a detergent raw material by using an oxidizer such as chlorosulfonic acid or sulfur dioxide gas. The average carbon number of the alkyl group is preferably 10 to 14. Also, the polyoxyalkylene alkyl ether sulfate may be obtained by adding EO to a straight-chain or branched primary alcohol or straight-chain secondary alcohol having an average carbon number of 10 to 18 in an amount of 0.5 to 5 mol in average per one molecule and then by sulfating the resulting product by using, for example, the method described in JP-A No. 9-137188. The average carbon number of the alkyl group is preferably 10 to 16. The alkyl sulfate may be obtained by sulfonating a straight-chain or branched primary alcohol or straight-chain secondary alcohol having 10 to 16 and preferably 10 to 14 carbon atoms by using $SO_3$ or chlorosulfonic acid, followed by neutralizing. The α-olefin sulfonate may be formed by sulfonating an α-alkene having 8 to 18 carbon atoms by using $SO_3$, followed by hydrating and neutralizing and is a mixture of a compound in which a hydroxy group is present in a hydrocarbon group and a compound in which an unsaturated bond is present. Also, as the α-sulfofatty acid lower alkyl ester salt, the carbon number of the alkyl group is preferably 10 to 16 and a methyl ester or an ethyl ester is preferable from the viewpoint of a detergent effect. As the salt, a sodium salt, potassium salt, magnesium salt, calcium salt, alkanolamine salt and ammonium salt are preferable and a sodium salt, potassium salt and magnesium salt are preferable from the viewpoint of a detergent effect.

In the present invention, a polyoxyethylenealkyl sulfate having 10 to 14 carbon atoms and an ethylene oxide addition mol number of 1 to 3 and alkylbenzene sulfonate having 11 to 15 carbon atoms are particularly desirable from the viewpoint of a detergent effect.

As the nonionic surfactant, compounds represented by the following formula (7) are preferable.

$$R^{10}\text{—O (EO)}_a\text{(PO)}_b\text{—OH} \quad (7)$$

wherein $R^{10}$ represents an alkyl or alkenyl group having 10 to 18 carbon atoms, a denotes an average addition mol number and is a number from 0 to 20 and b denotes an average addition mol number and is a number from 0 to 20, excluding the case where both a and b are 0.

The amphoteric surfactant preferably contains a compound selected from compounds represented by the formula (8) or (9) from the viewpoint of detergent effect.

$$R^{11}\text{—}[A\text{—}R^{12}]_c\text{—}\underset{R^{14}}{\overset{R^{13}}{N^+}}\text{—}O^- \quad (8)$$

wherein $R^{11}$ represents a straight-chain alkyl or alkenyl group having 8 to 16, preferably 10 to 16 and particularly preferably 10 to 14 carbon atoms, $R^{13}$ and $R^{14}$ independently represent an alkyl group or a hydroxyalkyl group having 1 to 3 carbon atoms and preferably a methyl group, an ethyl group or a hydroxyethyl group, $R^{12}$ represents an alkylene group having 1 to 5 and preferably 2 or 3 carbon atoms. A represents a group selected from —COO—, —CONH—, —OCO—, —NHCO— and —O— and c denotes a number of 0 or 1.

(9)

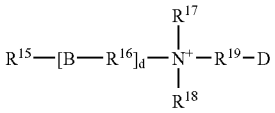

wherein $R^{15}$ represents an alkyl or alkenyl group having 9 to 23, preferably 9 to 17 and particularly preferably 9 to 15 carbon atoms, $R^{16}$ represents an alkylene group having 1 to 6 and preferably 2 or 3 carbon atoms, B represents a group selected from —COO—, —CONH—, —OCO—, —NHCO— and —O—, b denotes a number of 0 or 1, $R^{17}$ and $R^{18}$ independently represent an alkyl group or a hydroxyalkyl group having 1 to 3 carbon atoms, $R^{19}$ represents an alkylene group which has 1 to 5 and preferably 1 to 3 carbon atoms and may be substituted with a hydroxy group and D represents a group selected from $—COO^-—$, $—SO_3^-—$ and $—OSO_3^-—$.

As the cationic surfactant, it is preferable to use compounds represented by the following formulae (10) to (12).

(10)

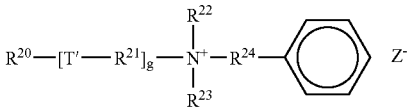

(11)

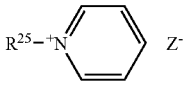

(12)

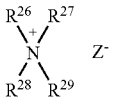

wherein $R^{20}$ and $R^{25}$ independently represent an alkyl group or an alkenyl group having 5 to 16 and preferably 6 to 14 carbon atoms and preferably an alkyl group, $R^{22}$ and $R^{23}$ independently represents an alkyl group or a hydroxyalkyl group having 1 to 3 carbon atoms, T' represents —COO—, —OCO—, —CONH—, —NHCO— or a group represented by the following formula:

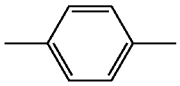

g denotes a number of 0 or 1, $R^{21}$ represents an alkylene group having 1 to 6 carbon atoms or $—(O—R^{30})_e—$ where $R^{30}$ represents an ethylene group or a propylene group and preferably an ethylene group and e denotes a number of 1 to 10 and preferably 1 to 5, $R^{24}$ represents an alkylene group having 1 to 5 and preferably 2 or 3 carbon atoms, $R^{26}$, $R^{27}$, $R^{28}$ and $R^{29}$ represent the following groups: two or more (preferably two) among them independently represent an alkyl group having 8 to 12 carbon atoms and the remainder groups independently represent an alkyl group or a hydroxyalkyl group having 1 to 3 carbon atoms, $Z^-$ represents an anionic group and preferably a halogen ion or an alkylsulfuric acid ion having 1 to 3 carbon atoms.

Most preferable examples of the cationic surfactant in the present invention include the following compounds:

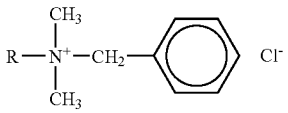

wherein R represents an alkyl group having 8 to 12 carbon atoms.

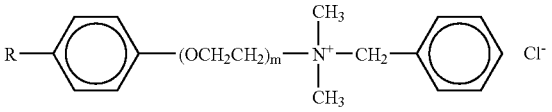

wherein R represents a straight or branched alkyl group having 6 to 10 carbon atoms and m denotes a number of 1 to 5; and

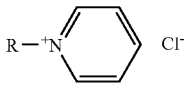

wherein R represents an alkyl group having 8 to 12 carbon atoms;

In the present invention, the nonionic surfactants represented by the formula (7) and the cationic surfactants represented by the formula (10) or (12) are preferable as the component (d). Particularly, the nonionic surfactants represented by the formula (10) are most preferable from the viewpoint of detergency. The composition of the present invention contains the component (d) in an amount of 0.01 to 10 mass % and more preferably 0.05 to 7 mass %.

In the present invention, a sequestering agent (hereinafter, referred to as a component (e)) is preferably contained for the purpose of more improving detergency. Examples of the metal ion sequestering agent may include:

(1) phosphoric acid type compounds such as phytic acid or alkali metal salts or alkanolamine salts of these compounds;

(2) phosphonic acids such as ehtane-1,1-diphosphonic acid, ethane-1,1,2-triphosphonic acid and ethane-1-hydroxy-1,1-diphosphonic acid and its derivatives, ethanehydroxy-1,1,2-triphosphonic acid, ethane-1,2-dicarboxy-1,2-diphosphonic acid and methanehydroxyphosphonic acid or alkali metal salts or alkanolamine salts of these phosphonic acids;

(3) phosphonocarboxylic acids such as 2-phosphonobutane-1,2-dicarboxylic acid, 1-phosphonobutane-2,3,4-tricarboxylic acid and α-methylphosphonosuccinic acid or alkali metal salts or alkanolamine salts of these acids;

(4) amino acids such as aspartic acid, glutamic acid and glycine or alkali metal salts or alkanolamine salts of these amino acids;

(5) aminopolycarboxylic acids such as nitrilotriacetic acid, iminodiacetic acid, ethylenediaminetetraacetic acid, diethylenetriaminepentaacetic acid, glycol ether diaminetetraacetic acid, hydroxyethyliminodiacetic acid, triethylenetetraminehexaacetic acid, diencoric acid, alkylglycine-N,N-diacetic acid, aspartic acid-N,N-diacetic acid, serine-N,N-diacetic acid, glutamic acid diacetic acid and ethylenediaminesuccinic acid or salts of these acids and preferably alkali metal salts or alkanolamine salts of these acids;

(6) organic acids such as diglycolic acid, oxydisuccinic acid, carboxymethyloxysuccinic acid, citric acid, lactic acid, tartaric acid, oxalic acid, malic acid, oxydisuccinic acid, gluconic acid, carboxymethylsuccinic acid and carboxymethyltartaric acid or alkali metal salts or alkanolamine salts of these acids;

(7) alkali metal salts or alkanolamine salts of aluminosilicic acid represented by zeolite A; and (8) aminopoly(methylenephosphonic acid) or its alkali metal salts or alkanolamine salts or polyethylenepolyaminepoly(methylenephosphonic acid) or its alkali metal salts or alkanolamine salts.

Among these compounds, at least one type selected from the group consisting of the above (2), (5), (6) and (7) is preferable and at least one type selected from the group consisting of the above (5) and (6) is more preferable. The composition of the present invention contains the component (e) in an amount of preferably 0.01 to 10 mass % and more preferably 0.05 to 7% by weight.

In the present invention, it is preferable to contain an alkali agent (hereinafter, referred to as a component (f)) from the viewpoint of detergency. As the alkali agent, sodium carbonate, potassium carbonate, sodium hydroxide, potassium hydroxide and amine compounds represented by the formulae (13) to (16) are preferable.

(13)

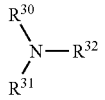

(14)

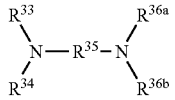

(15)

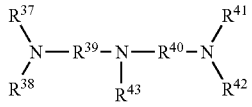

(16)

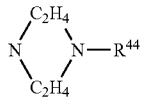

wherein $R^{29}$, $R^{30}$, $R^{31}$, $R^{32}$, $R^{33}$, $R^{35}$, $R^{36a}$, $R^{36b}$, $R^{37}$, $R^{38}$, $R^{41}$, $R^{42}$, $R^{43}$ and $R^{44}$ independently represent a hydrogen atom or an alkyl group or a hydroxyalkyl group having 1 to 4 carbon atoms, $R^{34}$, $R^{39}$ and $R^{40}$ independently represent an alkylene group having 1 to 6 carbon atoms in total, which can be substituted with a hydroxy group.

Examples of the compound represented by the formula (13) include ammonia, monoethanolamine, diethanolamine, N-methylpropanol and 2-amino-2-methyl-1-propanol. Examples of the compound represented by the formula (14) include N-(β-aminoethyl)ethanolamine and the like. Examples of the compound represented by the formula (15) include diethylenetriamine and the like. Examples of the compound represented by the formula (16) include morpholine and N-ethylmorpholine and the like. The alkali agent used in the present invention is preferably the compounds represented by the formula (13) or the compounds represented by the formula (16) to obtain excellent finish without leaving wiping lines and particularly preferably monoethanolamine, 2-amino-2-methyl-1-propanol and morpholine. The composition of the present invention contains the component (f) in an amount of preferably 0.05 to 10% by weight and particularly preferably 0.1 to 8% by weight from the viewpoint of a detergent effect.

The liquid detergent composition of the present invention has a pH of preferably 2 to 12 and more preferably 3 to 11 at 20° C. from the viewpoint of a detergent effect. As a pH regulator, acid agents including inorganic acids such as hydrochloric acid or sulfuric acid and organic acids such as citric acid, succinic acid, malic acid, fumaric acid, tartaric acid, malonic acid or maleic acid and the aforementioned alkali agents may be used either independently or in combinations. It is particularly preferable to use an acid selected from hydrochloric acid, sulfuric acid and citric acid and an alkali agent selected from sodium hydroxide, potassium hydroxide or the amine compounds represented by the formulae (13) to (16). The composition of the present invention has a viscosity of 1 to 100 mPa·s and preferably 1 to 50 mPa·s at 20° C. from the viewpoint of handling ability. Here, the viscosity meant in the present invention is measured using a B-type viscometer model BM manufactured by TOKIMEC. INC after the sample is aged in a thermostat kept at 20° C. for 30 minutes.

In the present invention, the composition preferably contains a hydrotropic agent for the purpose of improving storage stability. Specific and preferable examples of the hydrotropic agent benzenesulfonic acid substituted with 1 to 3 alkyl groups having 1 to 3 carbon atoms and its salts. More specific and preferable examples include p-toluenesulfonic acid, m-xylenesulfonic acid, p-cumenesulfonic acid and ethylbenzenesulfonic acid. When using a salt, sodium salts, potassium salts and magnesium salts are preferable.

Also, in the composition of the present invention, a polyalkylene glycol may be compounded to prevent gelation. The amount of the glycol to be compounded is preferably 0 to 1.0% by weight and more preferably 0 to 0.5% by weight in the composition for the purpose of adjusting the viscosity of the composition to an easily handlable one. Specific examples of the polyalkylene glycol to be compounded for preventing gelation, a polypropylene glycol and polyethylene glycol of which the weight average molecular weight found by gel chromatography using a polyethylene glycol as a standard is 500 to 20000 are preferable.

The liquid detergent composition of the present invention may contain a water-soluble solvent. The water-soluble solvent is an organic solvent of which the aforementioned sp value exceeds 21.0 and is 30.0 or less at 20° C. The water-soluble solvent is preferably one selected from ethanol, isopropylalcohol, ethylene glycol, propylene glycol, diethylene glycol, dipropylene glycol, glycerin, isoprene glycol, ethylene glycol monomethyl ether, ethylene glycol monoethyl ether, ethylene glycol monopropyl ether, ethylene glycol monobutyl ether, ethylene glycol monophenyl ether, ethylene glycol monobenzyl ether, diethylene glycol monomethyl ether, diethylene glycol monoethyl ether, diethylene glycol monopropyl ether, diethylene glycol monobutyl ether, diethylene glycol monohexyl ether, diethylene glycol monophenyl ether, diethylene glycol monobenzyl ether, propylene glycol monomethyl ether, propylene glycol monoethyl ether, propylene glycol monopropyl ether, propylene glycol monobutyl ether, propylene glycol monohexyl ether, dipropylene glycol monomethyl ether, dipropylene glycol monoethyl ether, dipropylene glycol monopropyl ether, dipropylene glycol monobutyl ether, polyoxypropylene (average addition mol number: 3 to 5) monomethyl ether, polyoxypropylene (average addition mol number: 3 to 5) monoethyl ether, polyoxyethylene (average addition mol number: 1 to 5) monophenyl ether, polyoxyethylene (average addition mol number: 1 to 5) monobenzyl ether and a monoalkyl monoglyceryl ether having the alkyl group having 3 to 8 carbon atoms.

Besides the above components, usual dispersants, chelating agents, perfumes, dyes, pigments, antiseptics and the like may be added to the liquid detergent composition of the present invention according to the need to the extent that the effect of the present invention is not impaired.

The reason why the liquid detergent of the present invention exhibits excellent detergency is that this is largely due to the qualities of the compound used as the component (a). The inventors of the present invention infer that in relation to the aforementioned fact that the compound used as the component (a) naturally tends to orient to the interface between the components (b) and (c), the component (b) is not firmly confined in the molecule of the component (a) in natural and also the number of carbons in the alkyl chain or alkenyl chain (R in the formula (1)) is smaller (the length of the chain is shorter) than that of a general surfactant, and therefore the component (a) is scarcely dissolved in the component (b), with the result that the original detergency of the bared component (b) will be obtained.

Moreover, the qualities of the component (a) enable the component (b) to be stabilized in such a state that it forms a continuous state in a system rich in water. This is inferred to be because the compound used as the component (a) scarcely forms globular micelles due to its structure. In the present invention, particularly, a composition in which both the phase of the component (b) and the phase of the component (c) form a continuous phase, namely, a so-called bicontinuous state is most preferable. Since the component (b) forms a continuous phase together with the component (c), more excellent detergency than that of a detergent consisting of an o/w type emulsion using a current surfactant can be obtained.

It is to be noted that the bicontinuous state is a phase state characterized in that an oil phase and a water phase are both continuous phases and is one described in "Journal of Japan Oil Chemical Association, vol. 45, No. 10 (1996), Control of Phase Equilibrium of Nonionic Surfactant Type" (KUNIEDA Hironobu, HASEGAWA Shinhiro) and "Chemical and Application of Surface Activation" (SEO Manabu, TSUJII Kaoru, published in 1993, Dai-Nippon Tosho (Kabushiki Kaisha)). For example, it is a state in which water and a hydrophobic organic solvent independently form a continuous phase as shown in FIG. 1.

Whether the component (b) forms a continuous phase or not can be confirmed, for example, by freezing the liquid detergent composition of the present invention rapidly to observe the cut section by using an electron microscope.

EXAMPLE

Figure 1:
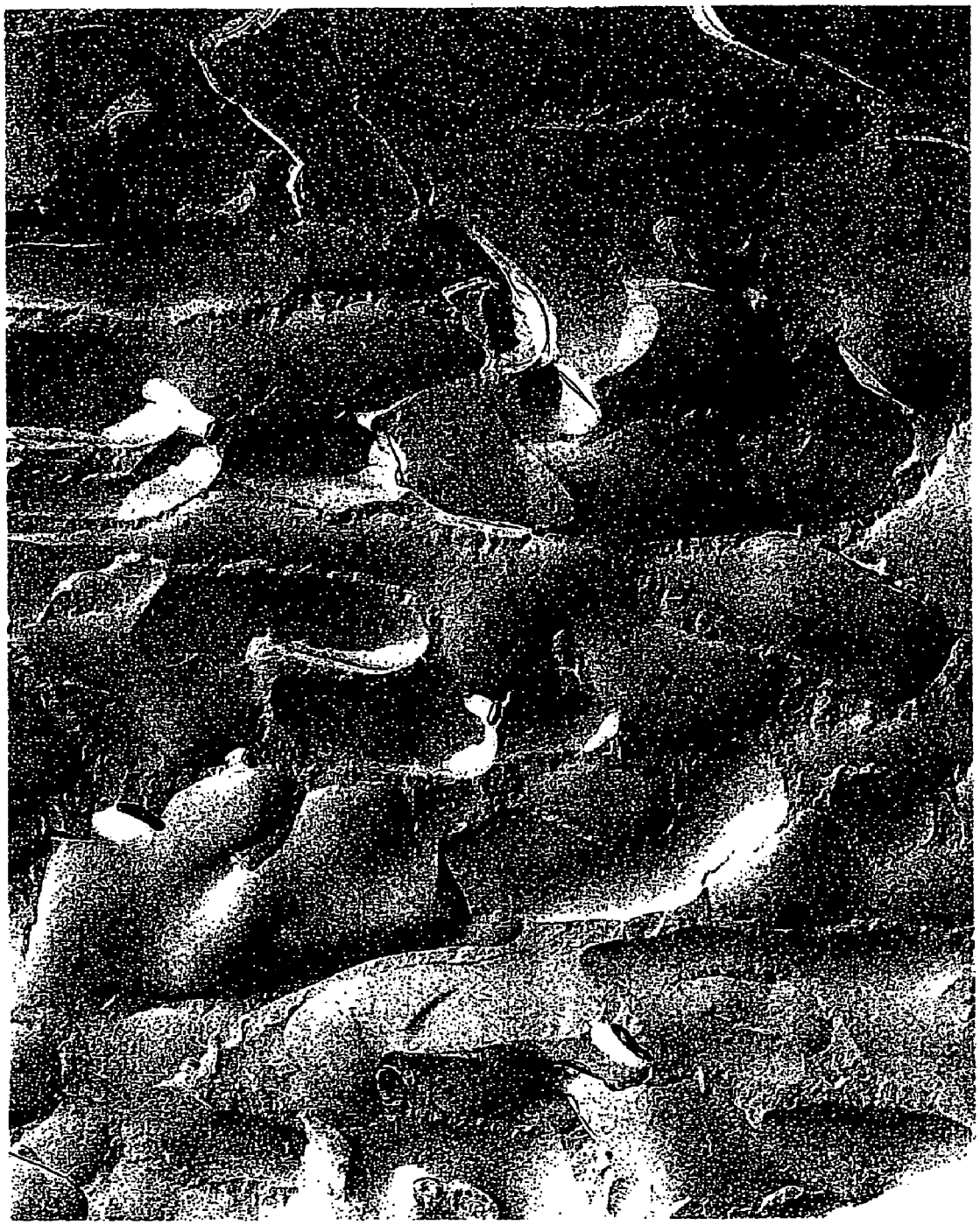
FIG. 1 is an electron microphotograph showing the phase state of the liquid detergent composition of Formulation Example 1-12.

The compounds (A), (B), (C), (D), (E), (F), (G) and (H) used in the following examples and comparative examples are compounds shown by the following formulae.

Compound (A)

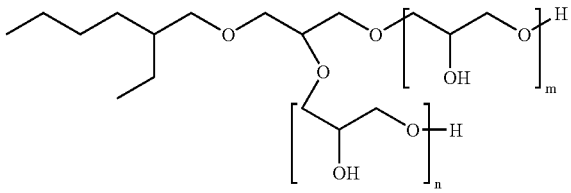

wherein m and n are independently a number of 0 or 1, provided that m+n=1. The compound (A) contains compounds represented by the above formula in which m and n are both 0 in an amount of 0.8 mass % based thereon.

Compound (B)

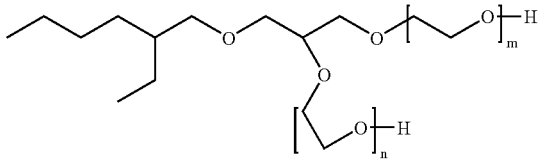

wherein m and n are independently a number of 0 or 1 provided that m+n=1. The compound (B) contains compounds represented by the above formula in which m and n are both 0 in an amount of 0.3 mass % based thereon.

Compound (C)

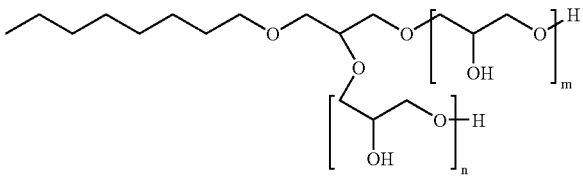

wherein m and n are independently a number of 0 or 1 provided that m+n=1. The compound (C) contains compounds represented by the above formula in which m and n are both 0 in an amount of 5 mass % based thereon.

Compound (D)

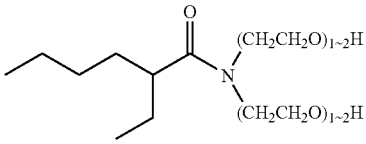

Compound (E)

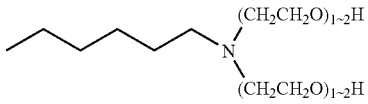

Compound (F)

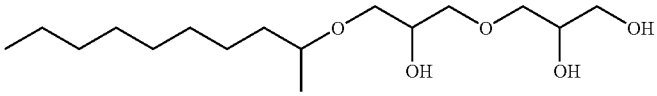

Compound (G)

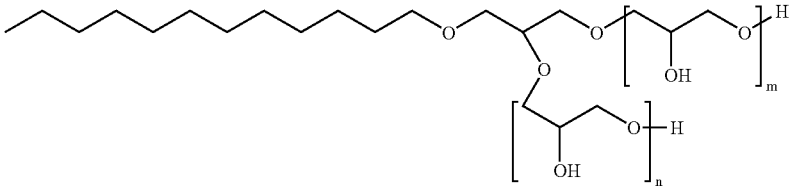

Compound (H)

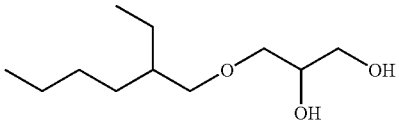

wherein m and n are independently a number of 0 or 1 provided that m+n=1.

Example 1

The liquid detergent compositions shown in Table 1 were prepared to examine the detergency and stability of each detergent composition by using the following methods. The composition of Table 1 was assumed as a detergent for kitchen facilities such as a range and a ventilation fan. With regard to the detergents shown in Table 1, detergency effected on oily stains was examined.

<Method of Evaluation>

1-1. Stability

○: Even if allowed to stand for one month or more at ambient temperature (10° C. to 30° C.), the sample is a stable transparent solution without any phase separation and cloudiness.

X: Phase separation, cloudiness and precipitation are caused in the same condition.

1-2. Detergency (Detergency Effected on Denatured Oily Stains)

10 g of "tempura" oil was uniformly applied to an iron plate and baked at 180° C. for 30 minutes. Further, the plate was allowed to stand at ambient temperature for 3 months to thereby form an almost dried film, thereby preparing a model soiled plate. About 0.5 ml of the liquid detergent composition was dripped on the model soiled plate which was secured horizontally and allowed to stand for one minute. Then, the floated soil was lightly removed using an absorbent cotton. This operation was repeated 20 times in total to observe each degree of detergency with the eye and the detergency was evaluated according to the following standard. The detergency of the sample was expressed as an average of the 20 degrees of detergency.

5: Soils are completely removed.

4: About 60% to 80% of the soils is removed.

3: About 50% to 60% of the soils is removed.

2: About 30% to 50% of the soils is removed.

1: About 30% or less of soils is removed.

0: Soils are not removed at all.

<Confirmation of Phase State>

The liquid detergent composition of Formulation Example 1–12 was rapidly put in a frozen state, which was then observed by an electron microscope to confirm the phase state. It was evidently observed that the undecane phase and the aqueous phase were each formed in a continuous phase. It was confirmed that the composition was formed in a bi-continuous phase. This state is shown in FIG. 1.

TABLE 1

| | | Compound example | | | | | | | | | | | | |
|---|---|---|---|---|---|---|---|---|---|---|---|---|---|---|
| | | 1-1 | 1-2 | 1-3 | 1-4 | 1-5 | 1-6 | 1-7 | 1-8 | 1-9 | 1-10 | 1-11 | 1-12 | 1-13 |
| Composition (a) (mass %) | Compound (A) | 17 | 17 | 7 | 28 | | | 4 | | 3 | 4 | | 13 | |
| | Compound (B) | | | | | 28 | | | | | | | | |
| | Compound (C) | | | | | | 7 | | | | | | | |
| | Compound (D) | | | | | | | | 10 | | | | | |
| | Compound (E) | | | | | | | | | | | 10 | | |
| | Compound (F) | | | | | | | | | | | | | 13 |
| (b) | Undecane (sp = 16.0) | 10 | | 2 | 5 | | 2 | 2 | | | | | 2 | 2 |
| | Dodecane (sp = 15.2) | | | | | | | | | 3 | | | | |

TABLE 1-continued

| | Compound example | | | | | | | | | | | | |
|---|---|---|---|---|---|---|---|---|---|---|---|---|---|
| | 1-1 | 1-2 | 1-3 | 1-4 | 1-5 | 1-6 | 1-7 | 1-8 | 1-9 | 1-10 | 1-11 | 1-12 | 1-13 |
| Limonene (sp = 17.3) | | 8 | | | 17 | | | 5 | | 2 | 5 | | |
| Butyl carbitol | | | 12 | 12 | | 12 | 8 | 12 | 20 | | 12 | 8 | 8 |
| Ethanol | | | | | | | | | | 10 | | | |
| Monoethanolamine | | | | | | | | 0.5 | | 0.5 | 0.5 | | |
| Diethanolamine | | | | | | | | | 0.5 | | | | |
| Laurylamidepropyl carboxybetaine | | | 5 | | | 5 | 3 | | | | | | |
| (c) Ion-exchange water | 73 | 75 | 74 | 55 | 55 | 74 | 83 | 72.5 | 73.5 | 83.5 | 72.5 | 77 | 77 |
| Total | 100 | 100 | 100 | 100 | 100 | 100 | 100 | 100 | 100 | 100 | 100 | 100 | 100 |
| (b)/(c) | 10/73 | 8/75 | 2/74 | 5/55 | 17/55 | 2/74 | 2/83 | 5/72.5 | 3/73.5 | 2/83.5 | 5/72.5 | 2/77 | 2/77 |
| (b) + (c) | 83 | 83 | 76 | 60 | 72 | 76 | 85 | 77.5 | 76.5 | 85.5 | 77.5 | 79 | 79 |
| pH (20° C.) | 7.0 | 7.0 | 7.0 | 7.0 | 7.0 | 7.0 | 7.0 | 10.8 | 10.8 | 10.8 | 10.8 | 7.0 | 7.0 |
| Stability | ○ | ○ | ○ | ○ | ○ | ○ | ○ | ○ | ○ | ○ | ○ | ○ | ○ |
| Detergency effected on oily stains | 4.5 | 4.4 | 4.6 | 4.4 | 4.1 | 4.4 | 4.8 | 4.8 | 4.5 | 4.3 | 3.9 | 4.7 | 4.2 |

Example 2

Table 2 shows examples of a liquid detergent composition for a bathroom and a bathtub. The stability of these compositions was evaluated in the same manner as in Example 1. Also, detergency effected on soap scum was evaluated according to the following method.

TABLE 2

| | | Compound example | | | | | | | | | | | | |
|---|---|---|---|---|---|---|---|---|---|---|---|---|---|---|
| | | 2-1 | 2-2 | 2-3 | 2-4 | 2-5 | 2-6 | 2-7 | 2-8 | 2-9 | 2-10 | 2-11 | 2-12 | 2-13 |
| Composition (mass %) | (a) Compound (A) | 17 | 17 | 7 | 28 | | | 4 | | 3 | 4 | | 13 | |
| | Compound (B) | | | | | 28 | | | | | | | | |
| | Compound (C) | | | | | | 7 | | | | | | | |
| | Compound (D) | | | | | | | | 10 | | | | | |
| | Compound (E) | | | | | | | | | | | 10 | | |
| | Compound (F) | | | | | | | | | | | | | 13 |
| | (b) Undecane (sp = 16.0) | 10 | | 2 | 5 | | 2 | 2 | | | | | 2 | 2 |
| | Dodecane (sp = 15.2) | | | | | | | | | 3 | | | | |
| | Limonene (sp = 17.3) | | 8 | | | 17 | | | 5 | | 2 | 5 | | |
| | Butyl carbitol | | | 12 | 12 | | 12 | 8 | 12 | 20 | | 12 | 8 | 8 |
| | Ethanol | | | | | | | | | | 10 | | | |
| | Citric acid | | | | | | | | 1 | 1 | | 1 | | |
| | EDTA-4Na | | | | | | | | 1 | 1 | 2 | 1 | | |
| | Diethanolamine | | | | | | | | | | 1 | | | |
| | Laurylamidepropyl carboxybetaine | | | 5 | | | 5 | 3 | | | | | | |
| | (c) Ion-exchange water | 73 | 75 | 74 | 55 | 55 | 74 | 83 | 71 | 72 | 81 | 71 | 77 | 77 |
| | Total | 100 | 100 | 100 | 100 | 100 | 100 | 100 | 100 | 100 | 100 | 100 | 100 | 100 |
| | (b)/(c) | 10/73 | 8/75 | 2/74 | 5/55 | 17/55 | 2/74 | 2/83 | 5/71 | 3/72 | 2/81 | 5/71 | 2/77 | 2/77 |
| | (b) + (c) | 83 | 83 | 76 | 60 | 72 | 76 | 85 | 76 | 75 | 83 | 76 | 79 | 79 |
| | pH (20° C.) | 7.0 | 7.0 | 7.0 | 7.0 | 7.0 | 7.0 | 7.0 | 7.0 | 7.0 | 10.0 | 7.0 | 7.0 | 7.0 |
| | Stability | ○ | ○ | ○ | ○ | ○ | ○ | ○ | ○ | ○ | ○ | ○ | ○ | ○ |
| | Detergency effected on soap scum | 4.7 | 4.6 | 4.7 | 4.5 | 4.3 | 4.7 | 4.8 | 4.8 | 4.6 | 4.4 | 4.0 | 4.7 | 4.2 |

2-1. Detergency (Detergency Effected on Soap Scum)

A washbowl (made of a polypropylene) which was actually used for three months and to which soap scum was stuck was rubbed forward and backward five times with a polyurethane sponge impregnated with the liquid detergent composition for evaluation with applying a load of about 500 g. This operation was repeated 20 times in total to observe each degree of detergency with the eye and the detergency was evaluated according to the following standard. The detergency of the sample was expressed as an average of the 20 degrees of detergency.

5: Soil removal is very good.
4: Soil removal is good.
3: Soils are removed unevenly.
2: A few soils are removed.
1: Almost no soil is removed.

Comparative Example 1

The liquid detergent compositions shown in Table 3 were prepared and evaluated as to stability, detergency effected on oily stains and detergency effected on soap scum in the same manner as in Examples 1 and 2. The results are shown in Table 3.

TABLE 3

| | | Comparative compound example | | | | | | | | | | |
|---|---|---|---|---|---|---|---|---|---|---|---|---|
| | | 1-1 | 1-2 | 1-3 | 1-4 | 1-5 | 1-6 | 1-7 | 1-8 | 1-9 | 1-10 | 1-11 |
| Composition (mass %) | (a) Compound (A) | 17 | | | 7 | 7 | 1 | | | 55 | | 3 |
| | Compound (B) | | | | | | | | | | | |
| | Compound (G) | | | | | | | 7 | | | | |
| | Compound (H) | | | | | | | | | | 17 | |
| | (b) Undecane (sp = 16.0) | | | 0.5 | | 50 | | | 10 | 10 | 10 | |
| | Dodecane (sp = 15.2) | | 2 | | | | | | | | | |
| | Limonene (sp = 17.3) | | | | | | 0.05 | 2 | | | | |
| | Butyl carbitol | 12 | 12 | 12 | 12 | | 1 | 12 | 12 | | | 20 |
| | Diethanolamine | | | | | | | | | | | 0.5 |
| | Laurylamidepropyl carboxybetaine | | | 7 | 5 | | | | 3 | | | |
| | (c) Ion-exchange water | 71 | 86 | 80.5 | 76 | 43 | 97.95 | 79 | 75 | 35 | 73 | 76.5 |
| | Total | 100 | 100 | 100 | 100 | 100 | 100 | 100 | 100 | 100 | 100 | 100 |
| | (b)/(c) | — | 2/86 | 0.5/80.5 | — | 50/43 | 0.05/97.95 | 2/79 | 10/75 | 10/35 | 10/73 | — |
| | (b) + (c) | 71 | 88 | 81 | 76 | 93 | 98 | 81 | 85 | 45 | 83 | 76.5 |
| | pH (20° C.) | 7.0 | 7.0 | 7.0 | 7.0 | 7.0 | 7.0 | 7.0 | 7.0 | 7.0 | 7.0 | 10.8 |
| | Stability | ○ | X | ○ | ○ | X | ○ | ○ | X | X | ○ | ○ |
| | Detergency effected on oily stains | 1.0 | 1.4 | 1.2 | 1.2 | 2.5 | 1.1 | 2.5 | 2.0 | 3.2 | 2.8 | 1.8 |
| | Detergency effected on soap scum | 1.8 | 2.0 | 1.9 | 1.8 | 2.6 | 1.1 | 2.5 | 2.2 | 3.1 | 3.0 | 2.0 |

The invention claimed is:

1. A liquid detergent composition comprising (a) a compound represented by the following formula (1), (b) a hydrophobic organic solvent which is liquid at 20° C. and (c) water, wherein (b)/(c)=0.05/9.95 to 4/6 (mass ratio) and (b)+(c)=50 to 99 mass %:

$$R\text{-}T\text{-}[S]_m \quad (1)$$

wherein R represents an alkyl or alkenyl group having 3 to 11 carbon atoms, T represents a group selected from the group consisting of —O—, —COO—, —OCO—,

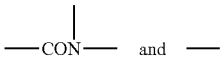

where m is 1 when T is —O—, —COO— or —OCO— and m is 2 when T is

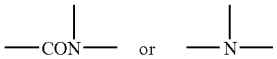

and S represents a group having 4 to 30 carbon atoms in total and 1 to 10 hydroxy groups, provided that m is 2 when S has one hydroxy group and when S has two hydroxy groups, at least one of the groups is a hydroxy group connected to an oxyethylene group or a polyoxyethylene group, the average added mole number being 5 or less and above 1, wherein R of the formula (1) has at least one of (i) a secondary carbon atom connected to an oxygen atom in T, (ii) a tertiary carbon atom and (iii) a quaternary carbon atom.

2. The liquid detergent composition according to claim 1, wherein (a) is a compound represented by the following formula (2):

$$R^1\text{—O—}CH_2CH(Y)CH_2\text{—}X \quad (2)$$

wherein $R^1$ represents an alkyl or alkenyl group having 3 to 11, X and Y independently represent a hydroxy group or —O—$CH_2CH(V)CH_2$—W, excluding the case where X and Y are both hydroxy groups, where V and W independently represent a hydroxy group or —O—$CH_2CH(V)CH_2$—W, wherein $R^1$ of the formula (2) has at least one of (i) a secondary carbon atom connected to an oxygen atom, (ii) a tertiary carbon atom and (iii) a quaternary carbon. atom.

3. The liquid detergent composition according to claim 1, wherein (b) is a hydrocarbon having 6 to 20 carbon atoms.

4. The liquid detergent composition according to claim 1, wherein the ratio by mass of (a)/(c) is 0.1/9.9 to 5/5.

5. The liquid detergent composition according to claim 1, comprising 0.1 to 30 mass % of (a), 0.05 to 20 mass % of (b) and 50 to 98 mass % of (c).

6. The liquid detergent composition according to claim 1, wherein (b) forms a continuous phase in the liquid detergent composition.

7. The liquid detergent composition according to claim 1, wherein (a) is a compound represented by the following formula (3):

$$R^1\text{—O—}CH_2CH(O(R^3O)_n\text{—H})CH_2\text{—}O(R^2O)_m\text{—H} \quad (3)$$

wherein $R^1$ represents an alkyl or alkenyl group having 3 to 11, $R^2$ and $R^3$ represents an ethylene group and/or a propylene group, m and n independently denote a number of 0 to 10, excluding the case where the both are 0 wherein $R^1$ of the formula (3) has at least one of (i) a secondary carbon atom connected to an oxygen atom, (ii) a tertiary carbon atom and (iii) a quaternary carbon atom.

8. The liquid detergent composition according to claim 1, wherein (a) is a compound represented by the following formula (4):

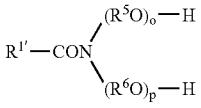

(4)

wherein $R^{1'}$ represents an alkyl or alkenyl group having 3 to 10 carbon atoms, $R^5$ and $R^6$ independently represent an alkyl or hydroxyalkyl group having 1 to 3 carbon atoms and o and p independently denote a number of 1 to 10 wherein $R^{1'}$ of the formula (4) has at least one of (i) a tertiary carbon atom and (ii) a quaternary carbon atom.

9. The liquid detergent composition according to claim 1, wherein (a) is a compound represented by the following formula (5):

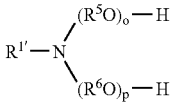

(5)

wherein $R^{1'}$ represents an alkyl or alkenyl group having 3 to 10 carbon atoms, $R^5$ and $R^6$ independently represent an alkyl or hydroxyalkyl group having 1 to 3 carbon atoms and o and p independently denote a number of 1 to 10, wherein $R^{1'}$ of the formula (5) has at least one of (i) a tertiary carbon atom and (ii) a quaternary carbon atom.

10. The liquid detergent composition according to claim 1, wherein said hydrophobic organic solvent has a solubility parameter of 10.0 to 21.0.

11. The liquid detergent composition according to claim 1, wherein said hydrophobic organic solvent is at least one selected from the group consisting of a hydrocarbon, a monohydric aliphatic alcohol, an ester of an monohydric aliphatic alcohol having 6 to 30 carbon atoms in total, a fatty acid ester or an aliphatic ketone.

12. The liquid detergent composition according to claim 1, wherein said water is ion exchanged water.

13. The liquid detergent composition according to claim 1, wherein said (b)/(c) ratio is 1/99 to 30/70.

14. The liquid detergent composition according to claim 1, wherein said (b)/(c) ratio is 2/98 to 10/90.

15. The liquid detergent composition according to claim 1, wherein (b)+(c) is 70 to 98 mass %.

16. The liquid detergent composition according to claim 1, wherein component (a) is present in an amount of 0.1 to 30 mass %.

17. The liquid detergent composition according to claim 1, wherein component (b) is present in an amount of 0.05 to 20 mass %.

18. The liquid detergent composition according to claim 1, wherein component (c) is present in an amount of 50 to 98.5 mass %.

19. The liquid detergent composition according to claim 1, further comprising a surfactant.

* * * * *